US007467436B1

(12) United States Patent
Jones

(10) Patent No.: US 7,467,436 B1
(45) Date of Patent: Dec. 23, 2008

(54) ADJUSTABLE RAMP

(76) Inventor: Michael Dean Jones, 514 Bella Vista Dr., Suisun City, CA (US) 94585

( * ) Notice: Subject to any disclaimer, the term of this patent is extended or adjusted under 35 U.S.C. 154(b) by 0 days.

(21) Appl. No.: 11/977,345

(22) Filed: Oct. 23, 2007

(51) Int. Cl.
*E01D 1/00* (2006.01)

(52) U.S. Cl. ..... 14/69.5

(58) Field of Classification Search ..... 14/69.5; 254/88; D34/32
See application file for complete search history.

(56) References Cited

U.S. PATENT DOCUMENTS 1,082,807 A * 12/1913 Holworthy ..... 188/32
3,297,320 A * 1/1967 Di Benedetto ..... 482/148
3,746,335 A * 7/1973 Fichter et al. ..... 482/19
4,013,268 A * 3/1977 Williams ..... 254/88
6,921,339 B1 * 7/2005 Martin et al. ..... 472/89
7,070,540 B1 * 7/2006 Priester ..... 482/14

* cited by examiner

*Primary Examiner*—Gary S Hartmann
(74) *Attorney, Agent, or Firm*—Risto A. Rinne, Jr.

(57) ABSTRACT

An apparatus for providing an adjustable height top edge of an inclined plane includes a generally planar inclined plane that is pivotally attached at a bottom end thereof at a pivot axis to a first end of a first base member and to a first end of a spaced-apart second base member. The first and second base members are parallel with respect to each other and include a first slot and a second slot, respectively. A slide bar having a first bar end and an opposite second bar end is disposed between the first base member and the second base member and is secured in position by a first screw that passes through the first slot and by a second screw that passes through the second slot. The top edge of the inclined plane is urged to a desired height and is retained in position by friction. The slide bar is urged toward the pivot axis until it is in contact with opposite sides of the inclined plane. The first and second screws are tightened to secure the inclined plane in position.

13 Claims, 2 Drawing Sheets

ADJUSTABLE RAMP

BACKGROUND OF THE INVENTION

1. Field of the Invention

The present invention, in general, relates to ramps and, more particularly, to adjustable incline ramps.

Ramps are well known devices that come in a variety of sizes and for a variety of purposes. However, certain needs have yet to be satisfied by existing types of ramps.

In a house, for example, there may be numerous occasions that require passage over a single step. A sunken living room or a shower entrance may require a single step up or down to accomplish. Normally, this is hardly even noticed however at certain times even these single steps can become obstacles to passage.

To a person in a wheelchair, the single step up or down into a sunken living room or into a shower stall can act as a bar to passage. A person who has just had surgery, for example knee surgery, may be able to walk on a level or slightly inclined surface, but may be unable to negotiate a step up or down. Moving company personnel when moving furniture may not see the step up or down into the living room and may stumble. The elderly, especially those with arthritis, may find steps difficult if not impossible to surmount. These are but a few examples of the many instances where a single step can become an impediment to travel.

A simple, inexpensive solution is needed in the form of an adjustable ramp. If the solution is inexpensive enough, it can be adjusted for any particular step and simply left there. If more than one step exists in a house or apartment or office, then additional adjustable ramps can be purchased, adjusted, and left wherever needed.

Ideally, the solution would not require difficult assembly other than a one time adjustment of the step height. Assembly can be difficult for the elderly and for certain others to accomplish.

Also, it is important that once the height or incline angle is set that that angle be retained. It could be disastrous if the ramp were to suddenly collapse or otherwise shift its incline angle while being used.

Accordingly, there exists today a need for an adjustable ramp that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and which are not specifically mentioned herein.

Clearly, such an apparatus would be a useful and desirable device.

2. Description of Prior Art

Ramps are, in general, known. While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an adjustable ramp that can be adjusted so that a top of an inclined plane of the ramp is equal to the height of a step.

It is also an important object of the invention to provide an adjustable ramp that is easily adjustable to accommodate the height of a step.

Another object of the invention is to provide an adjustable ramp that is inexpensive to manufacture.

Still another object of the invention is to provide an adjustable ramp that is lightweight.

Still yet another object of the invention is to provide an adjustable ramp that includes a mechanism that is able to retain an inclined plane at a desired angle under load.

Yet another important object of the invention is to provide an adjustable ramp that maintains an inclined plane at a desired angle under load by having most of the load applied to the ramp in such manner as to urge a slide bar downward, thereby maintaining its position.

Still yet another important object of the invention is to provide an adjustable ramp that can be set to a desired elevation by urging a slide bar toward a pivot axis of the ramp until a top of the inclined plane is disposed where desired, and then securing the slide bar in position.

A first continuing object of the invention is to provide an adjustable ramp that can be set to a desired elevation by urging a slide bar disposed in a pair of spaced-apart slots toward a pivot axis of the ramp until a top of the inclined plane is disposed where desired, and then securing the slide bar in position by tightening a screw on opposite ends of the slide bar, thereby securing the slide bar in position relative to the pair of slots.

A second continuing object of the invention is to provide an adjustable ramp that helps prevent misalignment of a slide bar from occurring during a setting of the ramp to a desired angle of incline.

A third continuing object of the invention is to provide an adjustable ramp that includes an inclined plane, an upper end of the inclined plane being adjustable from 6 inches in elevation to 9 inches in elevation above a surface.

A fourth continuing object of the invention is to provide an adjustable ramp that includes an inclined plane, an upper end of the inclined plane being adjustable from 1 inch in elevation to 9 inches in elevation above a surface.

A fifth continuing object of the invention is to provide an adjustable ramp that can be maintained in a desired position by a light tightening of a first screw and a second screw.

A sixth continuing object of the invention is to provide an adjustable ramp that is safe to use.

A seventh continuing object of the invention is to provide an adjustable ramp that retains an incline angle during use even if a first and a second screw are not sufficiently tightened.

An eighth continuing object of the invention is to provide an adjustable ramp that can be setup by unskilled people.

A ninth continuing object of the invention is to provide an adjustable ramp that does not require assembly prior to use.

Briefly, an adjustable ramp that is constructed in accordance with the principles of the present invention has a first base member with a first slot and a second base member with a second slot. An inclined plane includes a lower end and an opposite upper end and a first side and an opposite second side. The lower end at a first side thereof is pivotally secured to a first end of the first base member at a pivot axis. The lower end at a second side thereof is pivotally secured to a first end of the second base member at an opposite end of the pivot axis. A slide bar having a first bar end and an opposite second bar end is disposed between the first base member and the second base member. The slide bar includes a threaded hole at opposite ends thereof. A first screw passes through the first slot of the first base member and engages with the threaded hole of the first bar end. A second screw passes through the second slot of the second base member and engages with the threaded hole of the second bar end. The inclined plane is urged into the desired angle of incline. The slide bar is urged toward the pivot axis until it is in contact with the first side and the second side of the inclined plane. The first and second screws are tightened to secure the inclined plane in position.

DETAILED DESCRIPTION OF THE INVENTION

Figure 1:
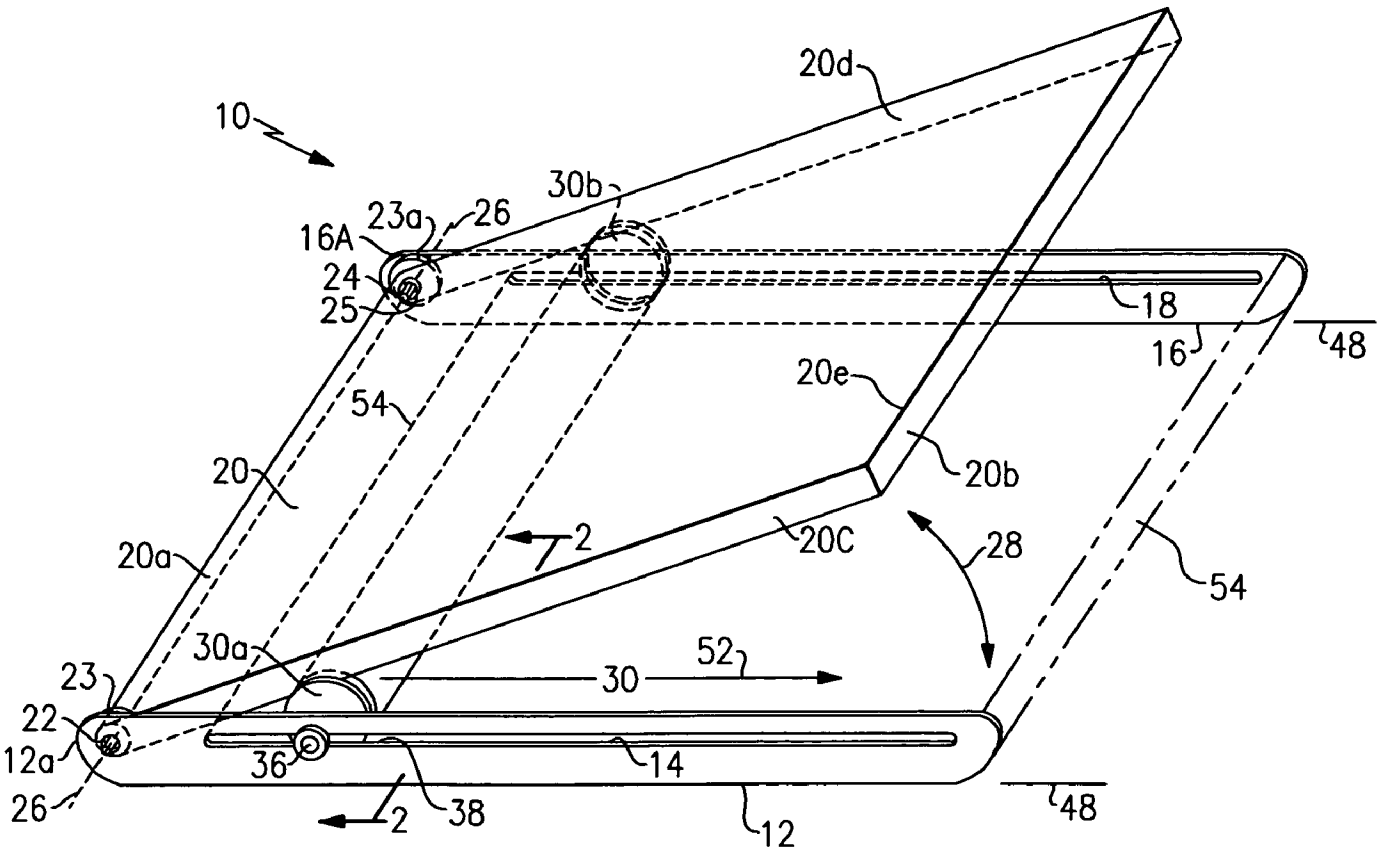
FIG. 1 is a view in perspective of an adjustable ramp set to a preferred angle of incline.

Referring to FIG. 1 is shown, an adjustable ramp, identified in general by the reference numeral 10.

The adjustable ramp 10 includes a first base member 12 with a first slot 14. The first slot 14 extends along a portion of a longitudinal length of the first base member 12 and is disposed on a first side of the adjustable ramp 10.

A second base member 16 with a second slot 18 that extends along a portion of a longitudinal length thereof is disposed on an opposite second side of the adjustable ramp 10.

An inclined plane 20 includes a lower end 20*a* (dashed line), and an opposite upper end 20*b*, a first side 20*c*, and an opposite second side 20*d* (dashed line) that are each attached to the inclined plane 20 along their respective longitudinal lengths.

The lower end 20*a* includes a planar member that is disposed perpendicular with respect to a plane of the inclined plane 20.

The upper end 20*b* includes a planar member that is disposed perpendicular with respect to a plane of the inclined plane 20.

The first side 20*c* includes a planar member that is disposed perpendicular with respect to a plane of the inclined plane 20.

The second side 20*d* includes a planar member that is disposed perpendicular with respect to a plane of the inclined plane 20.

A first opening (not shown) is provided through the first side 20*c* proximate the lower end 20*a*. A first fastener 22 passes through the first opening and through a corresponding adjacent second opening (not shown) that is provided proximate a first end 12*a* of the first base member 12. The first fastener 22 can include any preferred machine screw or similar type of fastener.

A third opening (not shown) is provided through the second side 20*d* proximate the lower end 20*a*. A second fastener 24 passes through the third opening and through a corresponding adjacent fourth opening (not shown) that is provided proximate a first end 16*a* of the second base member 16. The second fastener 24 can also include any preferred machine screw or similar type of fastener.

A first nut (not shown) on an inside portion of the adjustable ramp 10 cooperates with the first fastener 22 and secures the first base member 12 adjacent to and in parallel planar alignment with respect to the first side 20*c*. A first intermediate washer (23) is disposed between the first side 20*c* and the first base member 12 to offset the first base member 12 a predetermined distance away from the first side 20*c*.

A second nut 25 on an inside portion of the adjustable ramp 10 cooperates with the second fastener 24 and secures the second base member 16 adjacent to and in parallel planar alignment with respect to the second side 20*d*. A second intermediate washer 23*a* is disposed between the second side 20*d* and the second base member 16 to offset the second base member 16 a predetermined distance away from the second side 20*d*.

The first fastener 22 and the second fastener 24 each include a center longitudinal axis that are in alignment with respect to each other and which extends along the length of the lower end 20*a* including the thicknesses of the first intermediate washer, the second intermediate washer, the first base member 12, and the second base member 16.

The center longitudinal axis defines a pivot axis 26 (dashed lines) about which the inclined plane 20 is able to pivot in either direction, as shown by arrow 28, with respect to the first base member 12 and the second base member 16.

The first intermediate washer 23 that is used between the first base member 12 and the first side 20*c* is preferably made of plastic as is the second intermediate washer 23*a* that is used between the second base member 16 and the second side 20*d*.

The first fastener 22 is tightened to a predetermined torque setting sufficient to apply a desired force upon the first intermediate washer 23. The second fastener 24 is similarly tightened to a predetermined torque setting sufficient to apply a desired force upon the second intermediate washer 23*a*.

Accordingly, friction is created intermediate the inclined plane 20 and the first base member 12 and intermediate the inclined plane 20 and the second base member 16.

The friction that is created is sufficient to retain the inclined plane 20 in any desired position (i.e., angle) relative to the first and second base members 12, 16 after the inclined plane 20 is first urged into the desired position and providing that no additional load (other than the weight of the inclined plane 20 itself) is placed on the inclined plane 20.

Pivoting of the inclined plane 20 into the desired position and securing it in the desired position sufficient to withstand loading of the inclined plane 20 is discussed in greater detail hereinafter. For now it is sufficient to understand that the friction is intended to retain the inclined plane 20 in position for a short period of time until other means for retaining it in position are established, as described in greater detail hereinafter. Therefore, the friction is not intended to retain more weight than that of the inclined plane 20.

Figure 2:
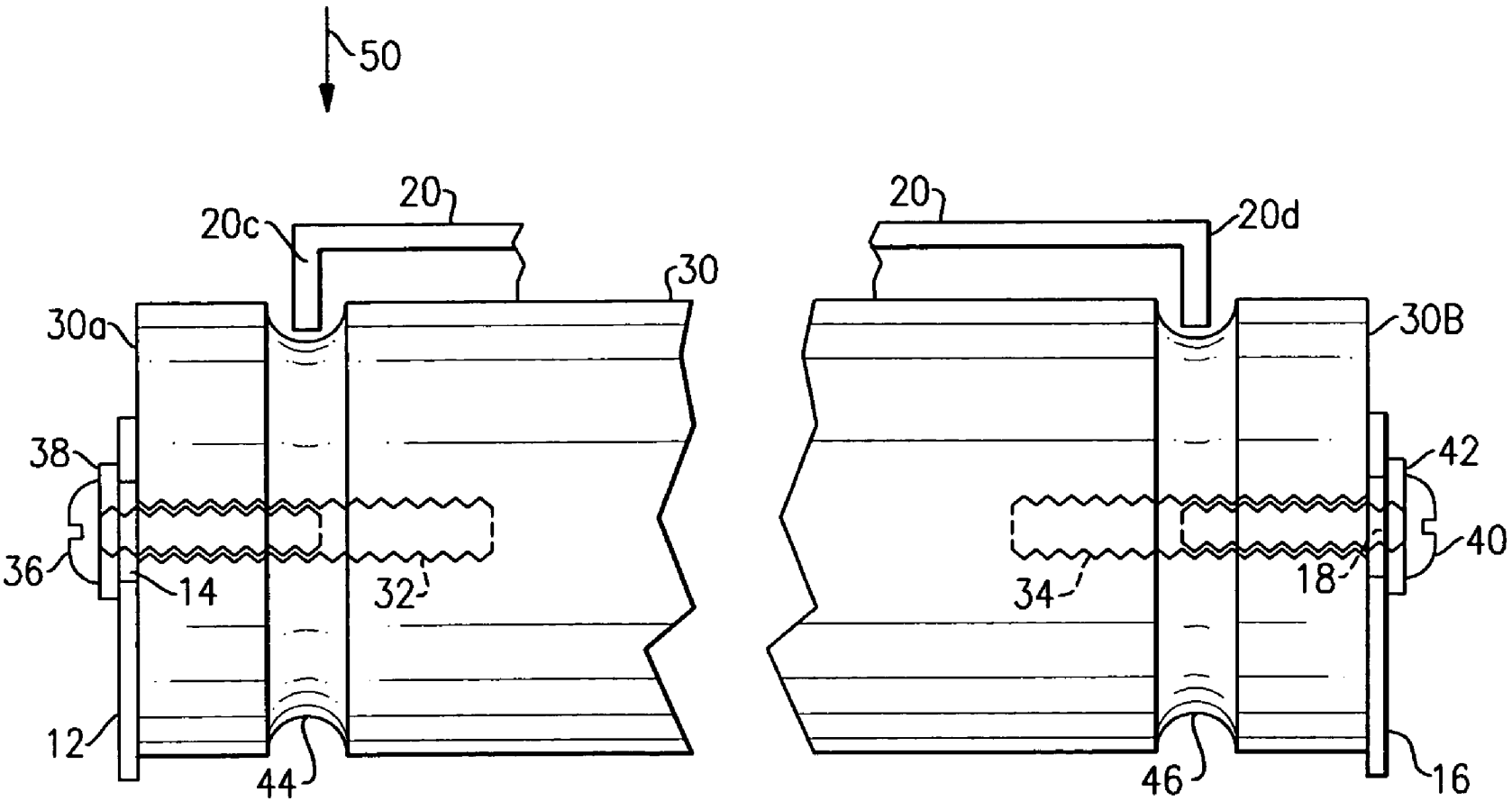
FIG. 2 is a cross sectional view taken on the line 2-2 in FIG. 1.

Referring now also on occasion to FIG. 2 is shown a slide bar 30 disposed under the inclined plane 20. The slide bar 30 includes a first bar end 30*a* and an opposite second bar end 30*b* that are disposed between the first base member 12 and the second base member 16.

The slide bar 30, as shown, is generally cylindrical in shape, although any preferred cross-sectional shape can be utilized. The slide bar 30 includes a pair of threaded holes 32, 34, one of each being disposed at opposite ends thereof.

A first screw 36 passes through a first washer 38 and then through the first slot 14 of the first base member 12 and engages with the threaded hole 32 disposed at the first bar end 30*a*. A second screw 40 passes through a second washer 42 and then through the second slot 18 of the second base member 16 and engages with the threaded hole 34 at the second bar end 30*b* of the slide bar 30. The first and second screws 36, 40 preferably include a preferred type of machine screw.

A first groove 44 is disposed around a circumference of the slide bar 30 proximate the first bar end 30*a*. During use, a bottom edge of the first side 20*c* rests on the slide bar 30 and is disposed in the first groove 44.

A second groove 46 is disposed around a circumference of the slide bar 30 proximate the second bar end 30*b*. During use, a bottom edge of the second side 20*d* rests on the slide bar 30 and is disposed in the second groove 46.

To set the inclined plane 20 for use, it is urged into the desired angle of incline. At the desired angle of incline a top edge 20*e* of the inclined plane 20 is set so that it is equal to a height of a top of a step (not shown) above a surface 48 upon which the adjustable ramp 10 is placed.

As previously mentioned, friction caused by a tightening of the first fastener 22 and the second fastener 24 is sufficient to temporarily retain the (unloaded) inclined plane 20 at the desired position.

The first screw 36 and the second screw 40 are then loosened slightly. The slide bar 30 is then urged toward the pivot axis 26 until it is in contact with the bottom edge of the first side 20*c* and is simultaneously in contact with the bottom edge of the second side 20*d* of the inclined plane 20.

In this position the slide bar 30 will always be disposed parallel with respect to the pivot axis 26 and the slide bar 30 will also always be disposed a predetermined distance away from the pivot axis 26.

The greater the height of the top edge 20*e* above the surface 48, the closer the slide bar 30 will be to the pivot axis 26. Conversely, the lower the height of the top edge 20*e* above the surface 48, the further away the slide bar 30 will be from the pivot axis 26.

The first and second screws 36, 40 are then tightened to secure the inclined plane 20 in the desired position.

The first and second groove 44, 46 provide an important unexpected benefit. As the bottom edges of the first side 20*c* and the second side 20*d* are disposed in the first and second grooves 44, 46 respectively, the slide bar 30 always seeks a parallel position with respect to the pivot axis 26 when it is urged toward the pivot axis 26.

This is important because the first and second grooves 44, 46 thereby help ensure that the inclined plane 20 will be supported in the desired position at both the first side 20*c* and also simultaneously at the second side 20*d*. This prevents possible side to side tipping of the inclined plane 20 from occurring during a loading of the adjustable ramp 10, which could be dangerous to a user standing on the inclined plane 20.

Were it not for the first and second grooves 44, 46, it would be easy to urge the slide bar 30 toward the pivot axis 26 during setup, believing it to be disposed parallel with respect to the pivot axis 26, while it is in fact skewed (i.e., not parallel with respect to the pivot axis 26). If the slide bar 30 is secured in place and is skewed, support of the inclined plane 20 can only occur on one side (either at the first side 20*c* or at the second side 20*d*); whichever end (either 30*a* or 30*b*) of the slide bar 30 is disposed closest to the pivot axis 26.

Another unexpected benefit is provided by the adjustable ramp 10 that further promotes safety and easy of setup in that the setup is fault-tolerant with regard to the degree that the first screw 36 and the second screw 40 are tightened.

While it is desirable to tighten the first and second screws 36, 40 to a predetermined and sufficient torque, it can be assumed that many users will have widely varying physical abilities to tighten the first and second screws 36, 40. Accordingly, the predetermined torque may not be attained.

When the inclined plane 20 is placed under load, as shown by arrow 50 (FIG. 2), the force is generally applied in what is predominantly a downward direction toward the surface 48. The downward direction, as shown by arrow 50, applies additional force that tends to urge the slide bar 30 downward where it bears with even greater force against a bottom edge of the first and second slots 14, 18.

Thereby, an additional loading of the inclined plane 20 supplies a force on the slide bar 30 that increases friction between the slide bar 30 and the first and second slots 14, 18. This additional friction further helps to retain the slide bar 30 in its current position.

This, in turn, allows for less than ideal tightening of the first and second screws 36, 40 while still retaining the slide bar 30, and therefore the top edge 20*e* of the inclined plane 20 at the desired height above the surface 48 during a loading of the inclined plane. Accordingly, the adjustable ramp is easy to setup and is especially safe to use. Furthermore, it can be safely setup and used by generally unskilled users.

By way of contrast, if an increased loading of the inclined plane 20 were to produce a force (which it does not) that tended to urge the slide bar 30 in a direction as shown by arrow 52 (FIG. 1), the first and second screws 36, 40 would then have to be tightened to a high torque setting in order to ensure that the slide bar 30 would not also be urged in the direction as shown by arrow 52, thereby causing a sudden downward collapse of the top edge 20*e* to occur. A sudden downward collapse could cause a user to fall and become injured.

As packaged during manufacture, the slide bar 30 is disposed as far away from the pivot axis 26 as possible. This allows for maximum lowering of the top edge 20*e* of the inclined plane 20 toward the first and second base members 12, 16, thereby allowing the adjustable ramp 10 to fit into as thin a container (box, not shown) as is possible.

It is important to note that the user does not have to do any assembly upon opening of the container and removal of the adjustable ramp 10 therefrom. The user need only urge the inclined plane 20 into the desired position, loosen the first screw 36 and the second screw 40, urge the slide bar 30 as far as possible toward the pivot axis 26, and then tighten the first screw 36 and second screw 40 to retain the inclined plane 20 in position. This allows for fast and easy setup of the adjustable ramp 10 for use.

Lock washers (not shown) can, of course, be used wherever desired.

The adjustable ramp 10 is provided with any preferred length and width. For most applications, the top edge 20*e* will be set from a height above the surface 48 of from 7 inches to about 9 inches. Of course, the adjustable ramp 10 can be set lower than 7 inches and its lowest possible position is limited only by the minimum amount the slide bar 30 elevates the inclined plane 20 when the slide bar 30 is distally disposed with respect to the pivot axis 26. Similarly, the adjustable ramp 10 can be modified so that the top edge 20*e* can be set to accommodate any desired height that is greater than 9 inches.

If desired, the first base member 12 and the second base member 16 can be replaced with a one-piece alternative assembly. For example, again referring to FIG. 1, a bottom panel 54 (dashed lines) can be attached at a first side thereof to a bottom of the first base member 12, and the bottom panel 54 can be attached at an opposite second side thereof to a bottom of the second base member 16, thereby joining the two base members 12, 16 together and providing the one-piece alternative. The slide bar 30 is disposed above the bottom panel 54.

An advantage of the one-piece alternative is that the load that is placed on the adjustable ramp 10 is distributed over a wider area of the surface 48 than would occur without the panel 54. A disadvantage of the one-piece alternative is the increased weight and cost of manufacture that would result.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An adjustable ramp, comprising:

(a) an inclined plane that includes a lower end and an opposite upper end, a first side, and an opposite second side;

(b) a base member, wherein said base member includes a pivot axis and wherein said pivot axis extends longitudinally through a first end of said base member and also through said lower end of said inclined plane, and (c) wherein said inclined plane is pivotally attached to said base member at said pivot axis and wherein said incline plane is adapted to pivot over a predetermined range from a first lower position into a second upper position;

(d) means for maintaining said inclined plane at a location within said predetermined range that said inclined plane is disposed at; and (e) wherein said base member includes a first base member and a second base member, and wherein said first side of said inclined plane includes a planar member that is perpendicular with respect to a plane of said inclined plane, and wherein said member is attached to said inclined plane at said first side thereof, and wherein said second side of said inclined plane includes a second planar member that is perpendicular with respect to said plane of said inclined plane, and wherein said second member is attached to said inclined plane at said second side thereof, and wherein said means for maintaining said inclined plane in a location includes a first fastener that passes through a first opening in said first side and through a second opening in said first base member, and including a second fastener that passes through a third opening in said second side and through a fourth opening in said second base member, and wherein when said first fastener and said second fastener are tightened, a friction intermediate said first base member and said first side and intermediate said second base member and said second side is sufficient to retain said inclined plane in said location.

2. The adjustable ramp of claim 1 wherein said means for maintaining said inclined plane in a location includes friction intermediate said inclined plane and said base member.

3. The adjustable ramp of claim 1 wherein said means for maintaining said inclined plane in a location includes a slide bar that is disposed in said base member and wherein said slide bar is adapted to be urged toward said pivot axis or away from said pivot axis, and wherein said slide bar includes means for retaining said slide bar in position relative to said base member, and wherein a portion of said inclined plane is adapted to rest on said slide bar.

4. The adjustable ramp of claim 1 including a first slot in said first base member that extends along a longitudinal length thereof and a second slot in said second base member that extends along a longitudinal length thereof, and including a slide bar that is disposed under said inclined plane and between said first base member and said second base member, and wherein said slide bar includes a threaded hole at a first bar end of said slide bar and another threaded hole at an opposite second bar end of said slide bar, and including a first screw that passes through said first slot and cooperates with said threaded hole at said first bar end and including a second screw that passes through said second slot and cooperates with said threaded hole at said second bar end, and wherein said first screw and said second screw, when tightened, retain said slide bar in position relative to said first base member and relative to said second base member, and wherein when said slide bar is urged toward said pivot axis until an upper portion of said slide bar is in contact with a portion of said inclined plane and said first and second screws are sufficiently tightened, said slide bar prevents said inclined plane from being urged closer toward said first base member and said second base member.

5. The adjustable ramp of claim 4 wherein said slide bar includes a first groove that is disposed around a circumference of said slide bar proximate said first bar end and wherein a bottom edge of said first side is disposed on said first groove, and a second groove that is disposed around a circumference of said slide bar proximate said second bar end and wherein a bottom edge of said second side is disposed on said second groove.

6. The adjustable ramp of claim 1 including a first intermediate washer that is disposed between said first side and said first base member, and wherein said first fastener passes through said first intermediate washer, and including a second intermediate washer that is disposed between said second side and said second base member, and wherein said second fastener passes through said second intermediate washer.

7. The adjustable ramp of claim 6 wherein said first intermediate washer includes a thickness that is equal to a distance said first groove is disposed from said first bar end, and wherein said second intermediate washer includes a thickness that is equal to a distance said second groove is disposed from said second bar end.

8. An adjustable ramp, comprising:

(a) an inclined plane that includes a lower end and an opposite upper end, a first side, and an opposite second side;

(b) a first base member and a second base member that are disposed in a spaced-apart parallel relationship with respect to each other, and wherein said first base member and said second base member include a pivot axis and wherein said pivot axis extends longitudinally through a first end of said first base member and said second base member and also through said lower end of said inclined plane, and (c) wherein said inclined plane is pivotally attached to said base member at said pivot axis and wherein said incline plane is adapted to pivot over a predetermined range from a first lower position into a second upper position; and (d) wherein said first side of said inclined plane includes a planar member that is perpendicular with respect to a plane of said inclined plane, and wherein said member is attached to said inclined plane at said first side thereof, and wherein said second side of said inclined plane includes a second planar member that is perpendicular with respect to said plane of said inclined plane, and wherein said second member is attached to said inclined plane at said second side thereof, and means for maintaining said inclined plane said second upper position includes a first fastener that passes through a first opening in said first side and through an adjacent second opening in said first base member, and including a second fastener that passes through a third opening in said second side and through an adjacent fourth opening in said second base member, and wherein when said first fastener and said second fastener are tightened, a friction intermediate said first base member and said first side and intermediate said second base member and said second side is sufficient to retain said inclined plane in said location providing a load is not applied to said inclined plane, and including a first slot in said first base member that extends along a longitudinal length thereof and a second slot in said second base member that extends along a longitudinal length thereof, and including a slide bar that is disposed under said inclined plane and between said first base member and said second base member, and wherein said slide bar includes a threaded hole at a first bar end of said slide bar and another threaded hole at an opposite second bar end of said slide bar, and including a first screw that passes through said first slot and cooperates with said threaded hole at said first bar end and including a second screw that passes through said second slot and cooperates with said threaded hole at said second bar end, and wherein said first screw and said second screw, when tightened, retain said slide bar in position relative to said first base member and relative to said second base member, and wherein said slide bar includes a cylindrical shape, and wherein said slide bar includes a first groove that is disposed around a circumference of said slide bar proximate said first bar end and wherein a bottom edge of said first side is disposed on said first groove, and a second groove that is disposed around a circumference of said slide bar proximate said second bar end and wherein a bottom edge of said second side is disposed on said second groove, and wherein when said inclined plane is disposed in said second upper position, said slide bar is urged toward said pivot axis until an upper portion of said first groove and said second groove are in contact with said bottom edge of said first side and said bottom edge of said second side, respectively, and wherein when said first and second screws are sufficiently tightened, said slide bar prevents said inclined plane from being urged out of said second upper position and closer toward said first base member and said second base member.

9. The adjustable ramp of claim 8 including a first intermediate washer, said first intermediate washer disposed between said first side and said first base member, and wherein said first fastener passes through said first intermediate washer, and wherein said first intermediate washer includes a thickness that is equal to a distance said first groove is disposed away from said first bar end of said slide bar.

10. The adjustable ramp of claim 9 wherein said first intermediate washer is formed of plastic.

11. The adjustable ramp of claim 9 including a second intermediate washer, said second intermediate washer disposed between said second side and said second base member, and wherein said second fastener passes through said second intermediate washer, and wherein said second intermediate washer includes a thickness that is equal to a distance said second groove is disposed away from said second bar end of said slide bar.

12. The adjustable ramp of claim 11 wherein said second intermediate washer is formed of plastic.

13. The adjustable ramp of claim 8 wherein said second upper position does not exceed nine inches.

* * * * *